US005833316A

United States Patent [19]

Hsieh

[11] Patent Number: 5,833,316

[45] Date of Patent: Nov. 10, 1998

[54] POSITIONING DEVICE FOR A WALKING CHAIR

[76] Inventor: Ping-Chao Hsieh, 5th Fl., No. 28, Hsi Wei St., Sanchung City, Taipei Hsien, Taiwan

[21] Appl. No.: 872,931

[22] Filed: Jun. 11, 1997

[51] Int. Cl.[6] ..... B62B 7/00

[52] U.S. Cl. ..... 297/344.21; 280/87.051

[58] Field of Search ..... 297/344.21; 280/87.051; 248/129, 131; 135/66, 67; 482/66

[56] References Cited

U.S. PATENT DOCUMENTS 5,056,776 10/1991 Cheng ..... 280/87.051 X
5,080,383 1/1992 Hsieh ..... 280/87.051 X
5,366,231 11/1994 Hung ..... 280/87.051
5,409,246 4/1995 Ali ..... 280/87.051
5,409,437 4/1995 Lauro et al. ..... 280/87.051 X
5,564,724 10/1996 Huang ..... 280/87.051
5,586,622 12/1996 Hu ..... 280/87.051 X
5,590,892 1/1997 Hu ..... 280/87.051

*Primary Examiner*—Peter M. Cuomo
*Assistant Examiner*—Rodney B. White
*Attorney, Agent, or Firm*—Foley & Lardner

[57] ABSTRACT

A positioning device for a walking chair is able to provide a positioning effect on the walking chair, so that a baby sitting within the walking chair will not be able to rotate freely with the walking chair, and thus the safety of the baby is ensured.

4 Claims, 5 Drawing Sheets

POSITIONING DEVICE FOR A WALKING CHAIR

FIELD OF THE INVENTION

The present invention generally relates to a positioning device, and more particularly to a positioning device for a walking chair. The positioning device enables the walking chair to be fixed at a certain position while a baby is using the walking chair to ensure the baby's safety.

BACKGROUND OF THE INVENTION

A conventional walking chair generally has a plurality of wheels pivotally connected to a base thereof. Each one of the wheels are able to rotate freely, so that a baby sitting within the walking chair is able to enjoy the pleasure of moving around especially when the baby is still unable to walk without assistance.

However, such a walking chair is not safe, because the walking chair does not have any decelerating device nor braking system mounted therein to prevent any unpredicted accidents. In this case, a baby sitting within the walking chair may get hurt when the wheels are all able to rotate freely. To solve this problem, a walking chair having an adjustable positioning device is introduced to the market. The walking chair having an adjustable positioning device which is able to be adjusted to a fixed position can only move circularly taking the adjustable positioning device as a center of the circular motion. When the adjustable positioning device is released to a freely rotatable position, like the conventional walking chair, movement in any direction is allowed but it is not practical.

Safety is a major concern for every one, parents will not allow any potential danger to threaten their children. Therefore, the walking chair which allows unrestricted movement in any direction can not fulfill our everyday needs and improvements or alterations thereof are thus required. A positioning device for a walking chair and constructed in accordance with the present invention tends to mitigate and/or obviate the aforementioned problems.

SUMMARY OF THE INVENTION

The main objective of the invention is to provide a positioning device for a walking chair. The positioning device includes an upper cover having a central extension defining a passage and a plurality of first seats, a weight material configured to have a diameter smaller than that of the upper cover so that the weight material is able to be received within the upper cover, a plurality of coil springs a first end of each being securely received within each one of the corresponding first seats, a plurality of whistling devices each of which is received within a corresponding coil springs, and a lower cover so configured that it mates with the upper cover and has a plurality of second seats for respectively receiving second ends of each of the plurality of coil springs and a plurality of cushions made of material which will deform when under pressure and mounted on a bottom face of the lower cover for engaging directly with the ground.

Another object of the invention is to provide a positioning device for a walking chair. The positioning device is able to replace a set of wheels, so that the walking chair becomes a rigid plate form to secure a baby in a stable position.

Other objects, advantages and novel features of the invention will become more apparent from the following detailed description when taken in conjunction with the accompanying drawings.

BRIEF DESCRIPTION OF THE DRAWINGS

The present invention will now be better understood with reference to the accompanying drawings wherein.

DETAILED DESCRIPTION OF THE PREFERRED EMBODIMENT

Figure 1:
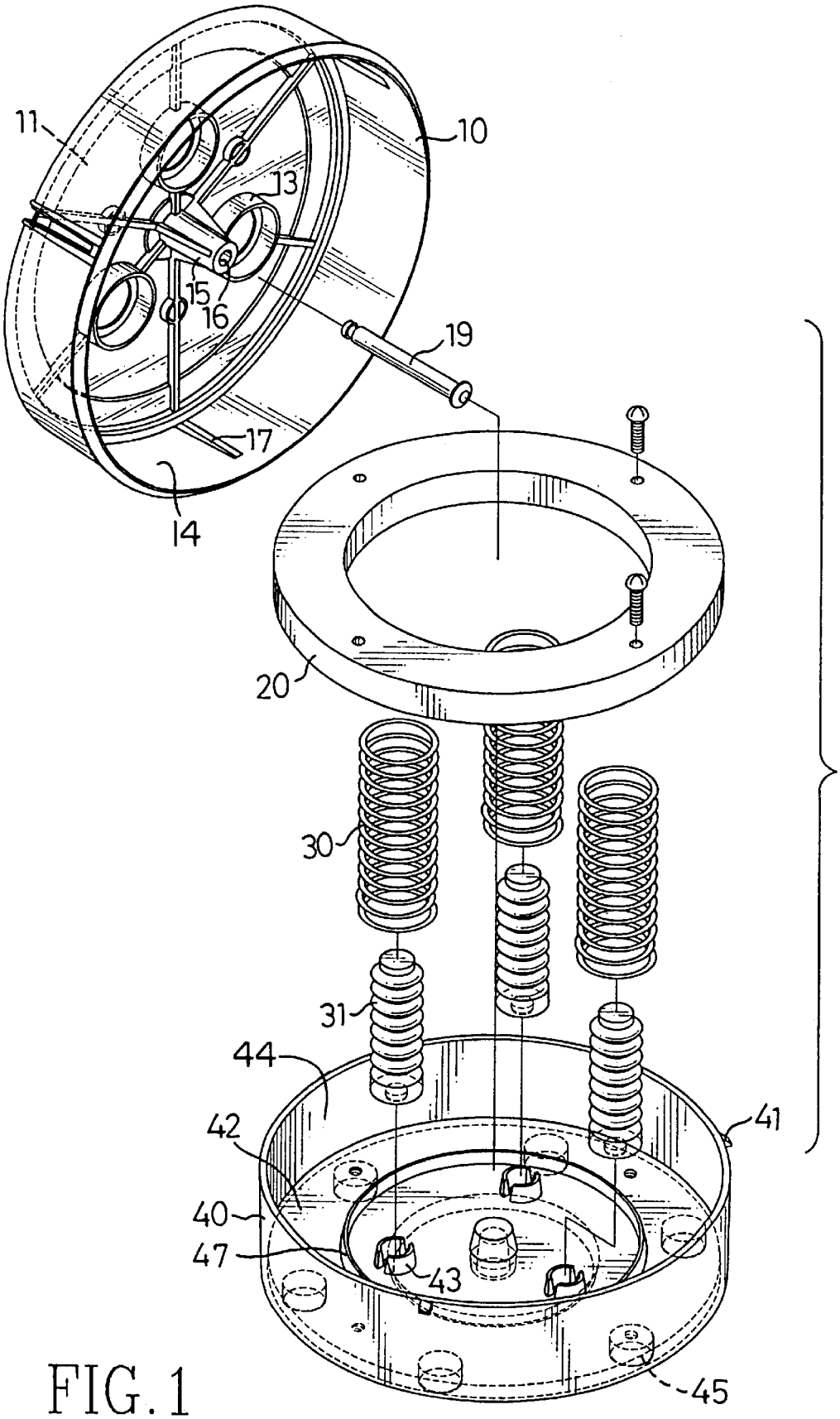
FIG. 1 is an exploded view of a positioning device constructed in accordance with a preferred embodiment of the present invention.

Referring to FIG. 1, one preferred embodiment of a positioning device constructed in accordance with the present invention is shown. The positioning device comprises an upper cover 10 having a closed side face 11 provided with a peripheral first flange 14 which defines therein a plurality of slits 17 and has a plurality of first seats 13 mounted thereon and further having an integrally formed central extension 15 defining a passage 16 therein, a weight material 20, a plurality of coil springs 30 whose first end are respectively received within the corresponding first seats 13, a plurality of whistling devices 31 respectively received within each of the corresponding coil springs 30, and a lower cover 40 having a bottom face 42 provided with a peripheral second flange 44 which mates with the first flange 14 and integrally has a plurality of protrusions 41 mounted thereto corresponding to the slits 17 of the upper cover 10 and further having a plurality of second seats 43 respectively corresponding to each of the first seats 13 and configured to receive each second end of the coil springs 30, a plurality of cushions 45 mounted onto the bottom face 42 and positioned to engage with the ground, and an inner ring 47 having a diameter smaller than that of an inner diameter of the weighing material 20, so that when the weight material 20 having a smaller outer diameter than that of an inner diameter of the lower cover 40 is received within the lower cover 40, the weighing material is able to be securely positioned between the inner ring 47 and the second flange 44.

When assembled, firstly the weighing material 20 is positioned between the second flange 44 and the inner ring 47, then the whistling devices 31 are respectively inserted into the corresponding coil springs 30 and afterward, the second ends of the coil springs 30 are respectively positioned onto the corresponding second seats 43. It is to be noted that in the embodiment as shown in FIG. 1, the weight material 20 is securely positioned onto the bottom face 42 of the lower cover 40 by means of screws (not numbered). Before a mating of the upper cover 10 with the lower cover 40 by the protrusions 41 of the lower cover 40 inserted into the slits 17 of the upper cover 10, a bolt 19 is inserted through the passage 16 of the extension 15 to be connected with a base of the walking chair (not shown).

Figure 2:
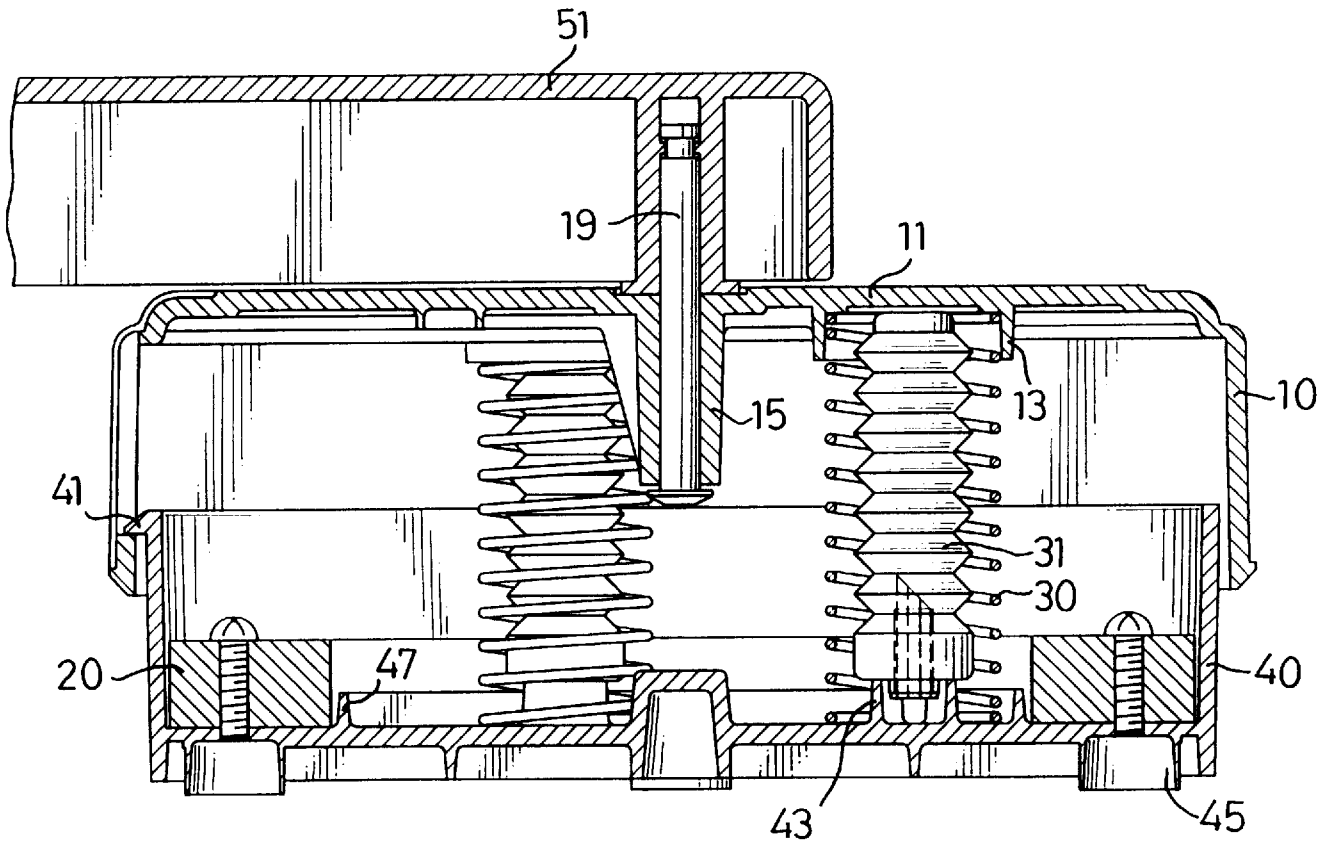
FIG. 2 is a sectional view of the positioning device when assembled.
Figure 3:
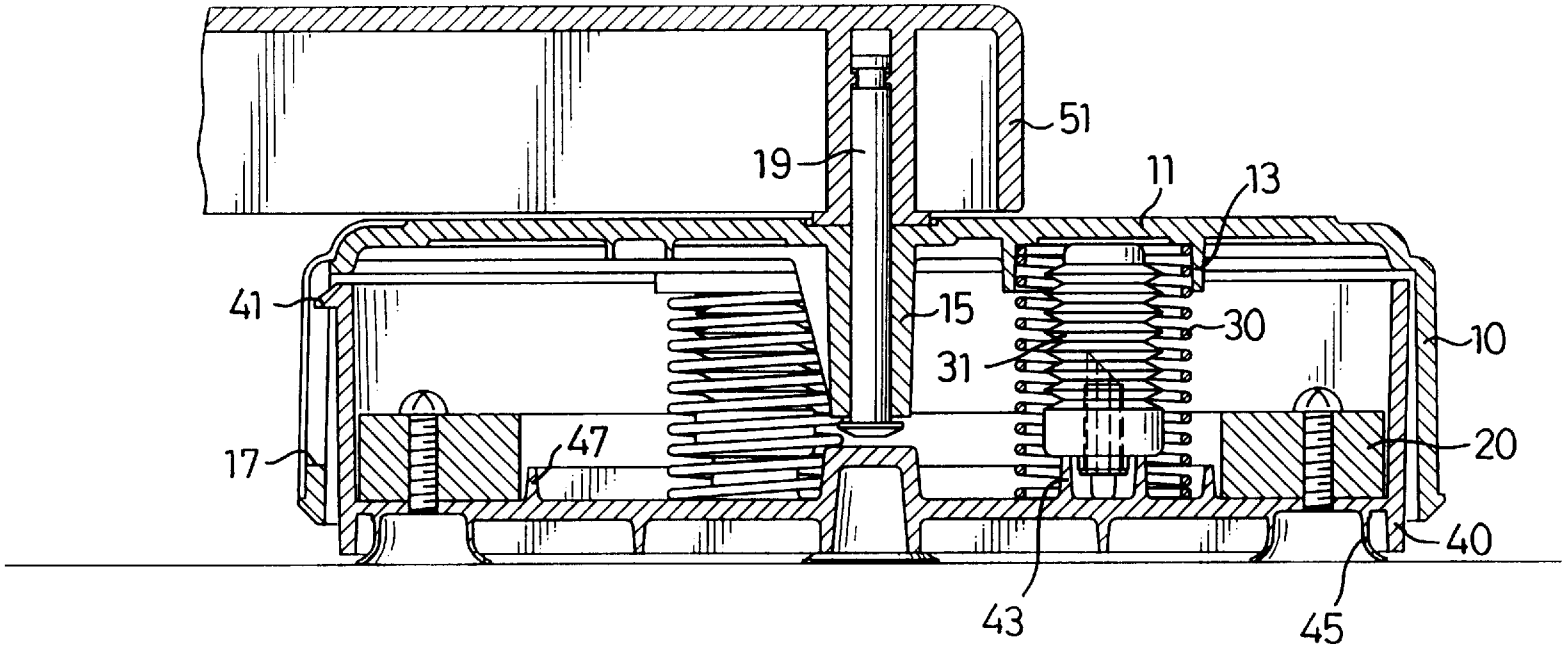
FIG. 3 is a schematic view of the positioning device showing that when the device is under pressure, each of the plurality of cushions will deform to increase the engaging area with the ground.
Figure 4:
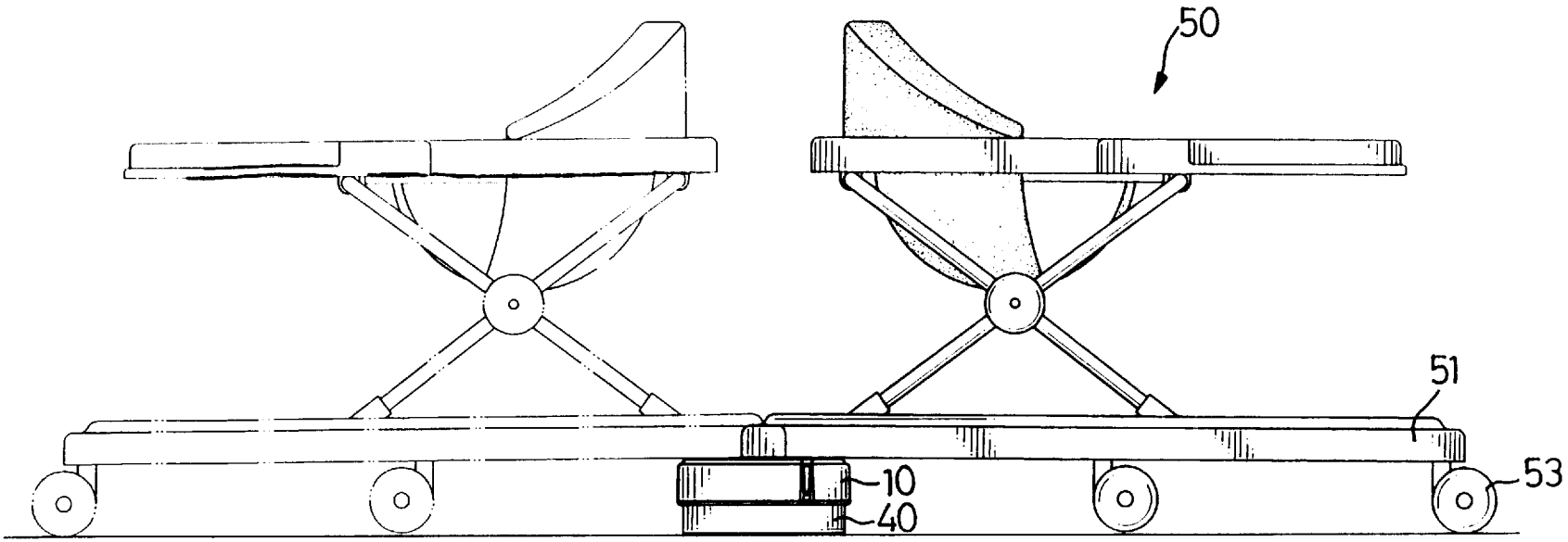
FIG. 4 is a schematic view showing a movement of the walking chair with the positioning device mounted thereto.

Referring to FIG. 2, it is notable that when the upper cover 10 and the lower cover 40 are connected by the insertion of the protrusions 41 into the slits 17, the ends of the coil springs 30 are respectively received within the corresponding first seats 13. Furthermore, the bolt 19 extends through the passage 16 of the upper cover 10 and thus releasably connects to a position where a wheel 53 is mounted (as shown in FIGS. 2 and 4). Therefore, when the positioning device of the invention is connected to the base 51, and a baby is sitting inside the walking chair 50, the cushions 45 will deform to increase a contact area with the ground to further stabilize the walking chair, as shown in FIG. 3.

In FIG. 4, the walking chair 50 has a plurality of wheels 53 rotatably mounted to a base 51 thereof and one wheel 53 is replaced by the positioning device of the invention. Due to a frictional force generated between the cushion 45 and the ground, the walking chair 50 can only move circularly, which ensures the safety of the baby sitting inside the walking chair 50.

Figure 5:
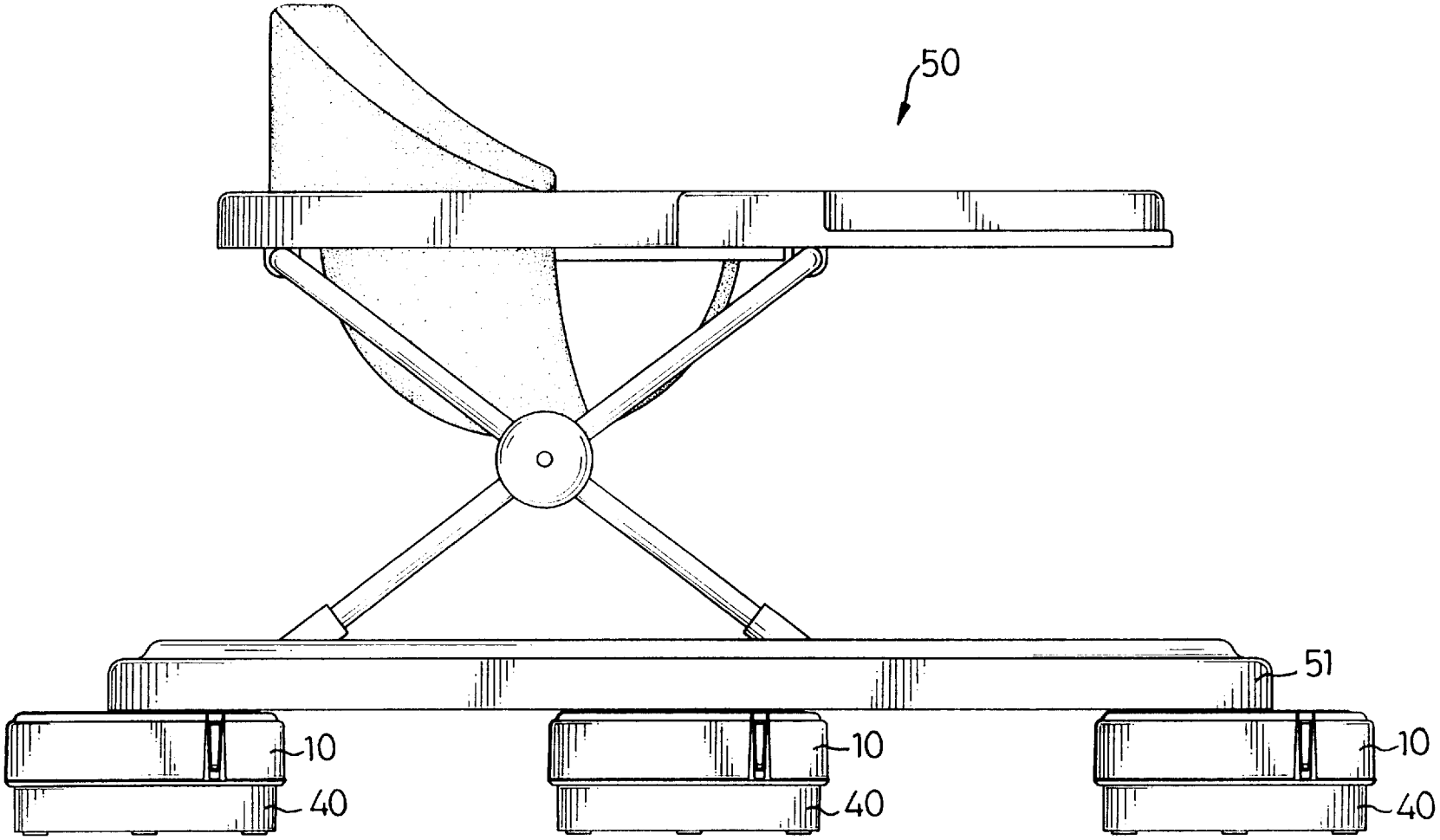
FIGS. 5 is a schematic view showing another embodiment of the present invention.

Referring to FIG. 5, another embodiment of the invention is shown. All of the wheels 53 are replaced by the positioning device, such that the walking chair becomes rigid and can serve as a cock-horse.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A position device for a walking chair comprising:

a circular lower cover having:

a bottom face integrally and peripherally provided with a circular first flange;

at least one protrusion formed on said first flange;

at least one first seat mounted onto said bottom face; and at least one cushion securely mounted on an opposite side of said bottom face relative to said at least one first seat;

at least one coil spring having a first end received within said first seat of said lower cover;

a weight material having an outer diameter smaller than a diameter of said first flange of said lower cover being received within said lower cover; and an upper cover having:

a closed side face;

a second flange integrally and peripherally formed with said closed side face and defining therein at least one slit corresponding to said protrusion of said lower cover;

at least one second seat mounted onto said closed side face and receiving a second end of said coil spring;

a central extension integrally formed thereon and having a passage adapted for allowing a bolt to be inserted therethrough for connecting the positioning device with respect to a base of said walking chair.

2. The positioning device as claimed in claim 1, wherein at least one whistling device is inserted into said coil spring.

3. The positioning device as claimed in claim 1, wherein an inner ring is formed within said lower cover and has a diameter smaller than an inner diameter of said weight material, such that said weight material is confined between said inner ring and said first flange of said lower cover.

4. The positioning device as claimed in claim 1, wherein said cushion is made of deformable material.

* * * * *